United States Patent [19]

Cauldwell

[11] 4,451,309

[45] May 29, 1984

[54] APPARATUS AND PROCESS FOR ALIGNING A PLATE AND MOUNTING IT ON A PRINT CYLINDER

[75] Inventor: Jack D. Cauldwell, Carroll, Ohio

[73] Assignee: Purity Packaging Corporation, Columbus, Ohio

[21] Appl. No.: 470,588

[22] Filed: Feb. 28, 1983

[51] Int. Cl.[3] ..... B41F 5/00

[52] U.S. Cl. ..... 156/64; 101/DIG. 12; 156/215; 156/285; 156/379; 156/447; 248/363

[58] Field of Search ..... 101/DIG. 12; 356/392; 354/73; 248/363, 441 A, 542; 269/21; 108/13, 62; 156/215, 64, 446–448, 379, 285

[56] References Cited

U.S. PATENT DOCUMENTS

| | | | |
|---|---|---|---|
| 2,741,868 | 8/1956 | Saunders | 108/62 |
| 3,167,036 | 1/1965 | Broussard | 108/13 |
| 3,455,758 | 7/1969 | Straughan | 156/215 |
| 3,773,594 | 1/1973 | Aaron et al. | 156/447 |
| 4,004,509 | 1/1977 | Moss | 101/216 |
| 4,019,434 | 4/1977 | Hoexter | 101/216 |
| 4,312,694 | 1/1982 | Sherman et al. | 248/363 |

FOREIGN PATENT DOCUMENTS

| | | | |
|---|---|---|---|
| 1261864 | 2/1968 | Fed. Rep. of Germany | 101/DIG. 12 |
| 1276054 | 8/1968 | Fed. Rep. of Germany | 101/DIG. 12 |
| 1940878 | 3/1970 | Fed. Rep. of Germany | 101/DIG. 12 |
| 2645166 | 4/1978 | Fed. Rep. of Germany | 101/DIG. 12 |
| 319327 | 3/1957 | Switzerland | 101/DIG. 12 |
| 2083411 | 3/1982 | United Kingdom | 101/DIG. 12 |

*Primary Examiner*—Jerome W. Massie
*Attorney, Agent, or Firm*—Millard & Cox

[57] ABSTRACT

A flexible printing plate is mounted on a print cylinder by first disposing the plate on a porous transparent panel and securing the plate in place by drawing a vacuum on the side of the porous panel opposite the plate. The panel is pivoted to a position where an operator may view the printing side of the plate and adjust the same according to indicia on the panel to insure proper alignment. Next the panel is rotated to a position where the exposed surface of the plate may be brought into contact with a properly aligned print cylinder. Adhesive on the cylinder will bond it to the plate in line contact and after the vacuum is released the free ends of the flexible plate will be drawn around the print cylinder.

11 Claims, 6 Drawing Figures

FIG. 3
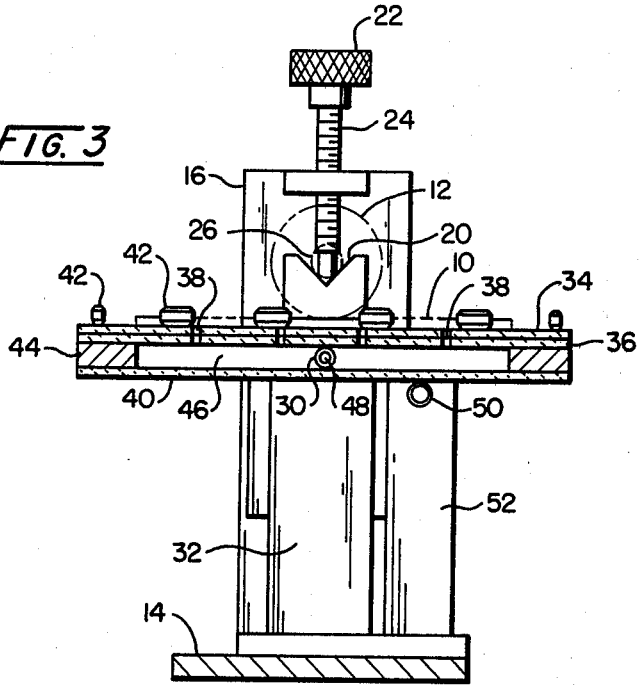
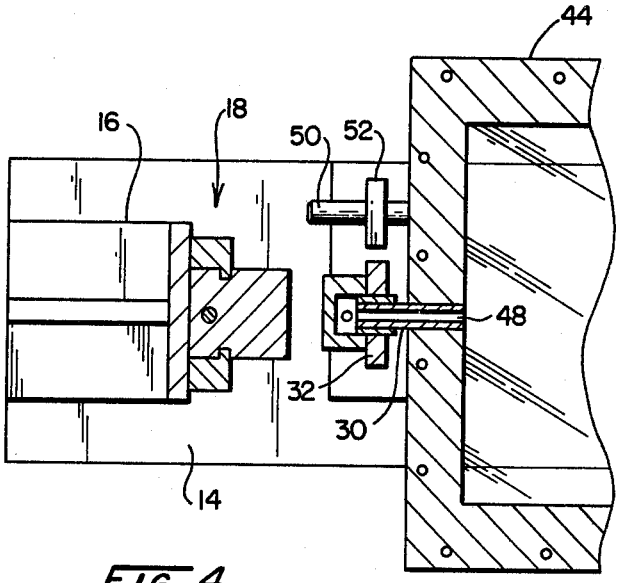
FIG. 4

APPARATUS AND PROCESS FOR ALIGNING A PLATE AND MOUNTING IT ON A PRINT CYLINDER

FIELD OF THE INVENTION

This invention relates to a process and apparatus for mounting flexible printing plates on plate cylinders.

BACKGROUND OF THE INVENTION

In the printing industry there are numerous applications for repeat printing of designs on paper and such a process is described in U.S. Pat. Nos. 4,004,509 and 4,019,434 listing Moss and Hoexter, respectively, as inventors. The complicated apparatus therein illustrated is representative of the prior art. The herein described invention accomplishes the desired result faster, easier and more accurately with a considerable savings in time and money. By way of example, one use of the process described herein is printing on sheets of layered paper which printed paper is subsequently adhered to the tops of the small cream containers such as are dispensed with coffee in various restaurants. The process described is certainly not limited to that product but it will give one an understanding of the magnitude of the number of repeat printings that must be made.

The machines involved in the printing itself are arranged to print a plurality of words and designs across a paper dispensed from a large wide roll. After the printing sequence the paper is fed to a cutter which will cut the paper in strips and in a pre-arranged set of designs which will be wound in rolls, packaged and shipped to the desired destination where the printed cut paper is used for its intended purpose.

The problem in the industry is the complicated process by which the printing plate is mounted on the print cylinder. Getting the flexible print plate in perfectly aligned position is difficult. Everyone has seen a cream container lid bearing trademarks and instructions which is printed off-center and often part of the printed material designed to appear on the label has been severed.

The problem becomes even more acute when the print sequence is designed to have two or three colors printed on the label. Inherently, such printing involves a plurality of print cylinders, one for each color. The print cylinders will be mounted in tandem, each bearing its own color and the cylinders will sequentially print on the roll of paper as it passes. The color coordination of the print cylinders can be adjusted by the machine operator during the printing process if one color is advanced or retarded with respect to the other color on the label. However, the machine operator has no adjustment mechanism for realigning the plate on the cylinder. If the plate is not mounted "square" at the outset, the color coordination on the resulting labels will be offset. To correct the improper alignment the printing plate must be stripped from the cylinder and another plate assembled to take its place.

The customary procedure is to mount the plate by hand on a stationary print wheel or print cylinder using one of a plurality of optical apparatus, some of which is described in the two above-identified patents. The degree of hand-eye coordination in the mounting of such plates varies from one individual to another and it is conceded that the mounting is an art rather than a science at this stage. Sometimes the artisan believes the plate has been mounted correctly but the only true test is when it is assembled on a printing machine. The "down time" on a printing machine to disassemble, reassemble and check a printing cylinder on such a machine which turns out millions of labels per day is not an inconsiderable economic problem.

The assembling of the flexible printing plate on the print cylinder is difficult from another standpoint besides the obvious one of coordinating hand movements with the eye observation using the optical apparatus provided for the mounting system. The plates themselves are flexible and elastic. The print cylinders have adhesive applied to their surface prior to the time the printing plates are applied. The "sticky back" applied to the print cylinder is a particularly good adhesive and sets up immediately upon contact. Accordingly, two mutually exclusive mistakes are possible. One is the misalignment in the first place or touching the print cylinder with the back of the flexible printing plate prematurely can result in instant misalignment. Also when the operator is attempting to apply the plate to the cylinder, the plate is sometimes placed in tension and the stretched plate will have a distortion in the label itself even though it may be very close to alignment. Once a plate is in contact with the print cylinder, if it is not perfect the operator must start all over again with a new printing plate and cylinder. The plate cannot simply be pulled loose to start again.

With this in mind, an apparatus was designed to eliminate the complicated hand-eye coordination problems and the optical apparatus from the plate mounting process.

SUMMARY OF THE INVENTION

The resulting apparatus allows the printing plate to first be mounted on a porous transparent panel with the print surface facing the panel. A vacuum is drawn on the printing plate to hold it in place on the panel. The panel is then rotated to a position such that the operator of the mounting apparatus can view the print side of the plate through the transparent porous panel and align the printed material of the plate according to indicia associated with the panel. The magnitude of vacuum drawn on the plate is designed to be less than one which would hold the plate rigidly in place or which would require elastomeric distortion of the plate to shift it slightly on the panel. The vacuum will hold the plate in place against the force of gravity but it will shift positions easily with respect to the panel in response to finger pressure.

After the plate is properly aligned on the panel, the panel is rotated to a horizontal position and a print cylinder having its axis parallel with the surface of the panel is brought into contact with the exposed surface of the printing plate such that it is adhered thereto. The free portions of the plate are then drawn about the cylinder after the vacuum is released such that the exposed surface of the printing plate is then adhered to the cylinder and the exposed surface facing outwardly from the cylinder will then be the printing surface.

Objects of the invention not obvious from the above will be clear from a detailed reading of the specification describing the preferred embodiments.

BRIEF DESCRIPTION OF THE DRAWINGS

FIG. 3 is a sectional view taken along line 3—3 of FIG. 2.

FIG. 4 is a sectional view taken along line 4—4 of FIG. 1.

DESCRIPTION OF THE PREFERRED EMBODIMENTS

Figure 1:
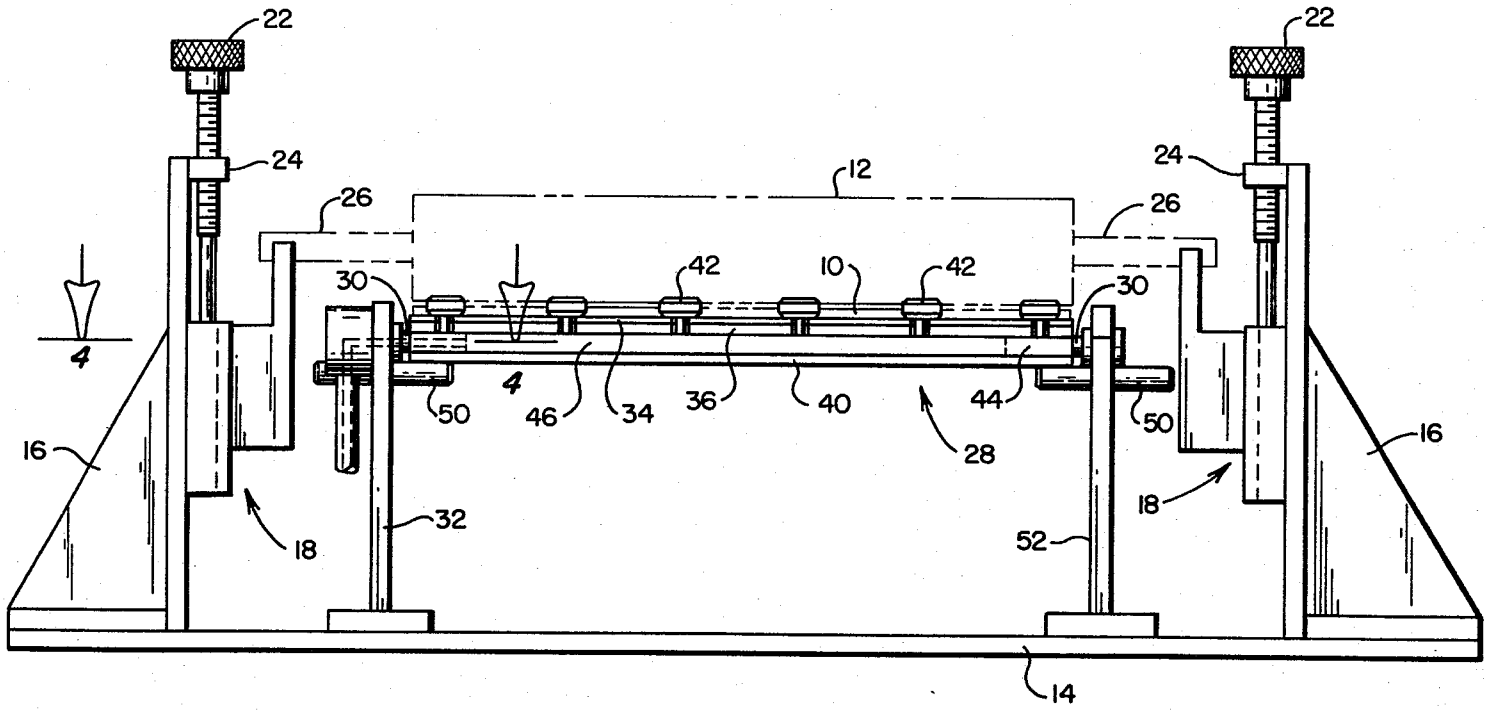
FIG. 1 is a side-elevational view of the apparatus for mounting a printing plate on a print cylinder according to this invention.

Looking to FIG. 1, the apparatus for mounting a flexible printing plate 10 on a cylindrical print cylinder 12 is illustrated as an elevational view.

The apparatus is supported on a base 14 and at each end are upwardly-extending brackets 16. The inwardly facing surface of each bracket 16 engages a screw-threaded reciprocal support bracket 18. Each bracket 18 includes an upwardly facing V-shaped trough 20, best seen in FIG. 3.

Reciprocation of bracket 18 is achieved by hand-manipulated screws 22 which threadedly engage apertures in shoulders 24 which are rigidly secured or integral with the upper ends of brackets 16. The lower ends of the screws 22 are journaled in reciprocating brackets 18 to raise and lower the same along with the V-shaped trough 20 which is rigidly attached to the support bracket 18. In the illustration shown, the two support brackets 18 are separately manipuable and can be adjusted individually, however, it is the intention of this invention to have the plate cylinder 12 descend into contact with printing plate 10 such that there is essentially line contact for the full length of the plate at the time of initial contact. That is to say, the plate cylinder 12 and the spindles 26 are coaxially aligned and because they are supported in the V-shaped trough 20, said axis is designed to be parallel with the panel surface supporting the printing plate 10.

The printing plate 10 is supported on a composite or layered panel generally indicated at 28, which is in turn suspended at each of its ends on pins 30 which project through openings in upwardly extending shafts 32. Pins 30 are aligned coaxially and the panel is so mounted on the pins that its upper support surface as shown in FIGS. 1 and 3 is parallel with the axis of pins 30.

The composite panel 28 shows an upper transparent section 34 juxtaposed to a first transparent panel 36. It will be observed that both the transparent section and the first transparent panel include openings 38 therethrough which are in register and thereby air may pass therethrough for reasons which will be explained subsequently.

Figure 2:
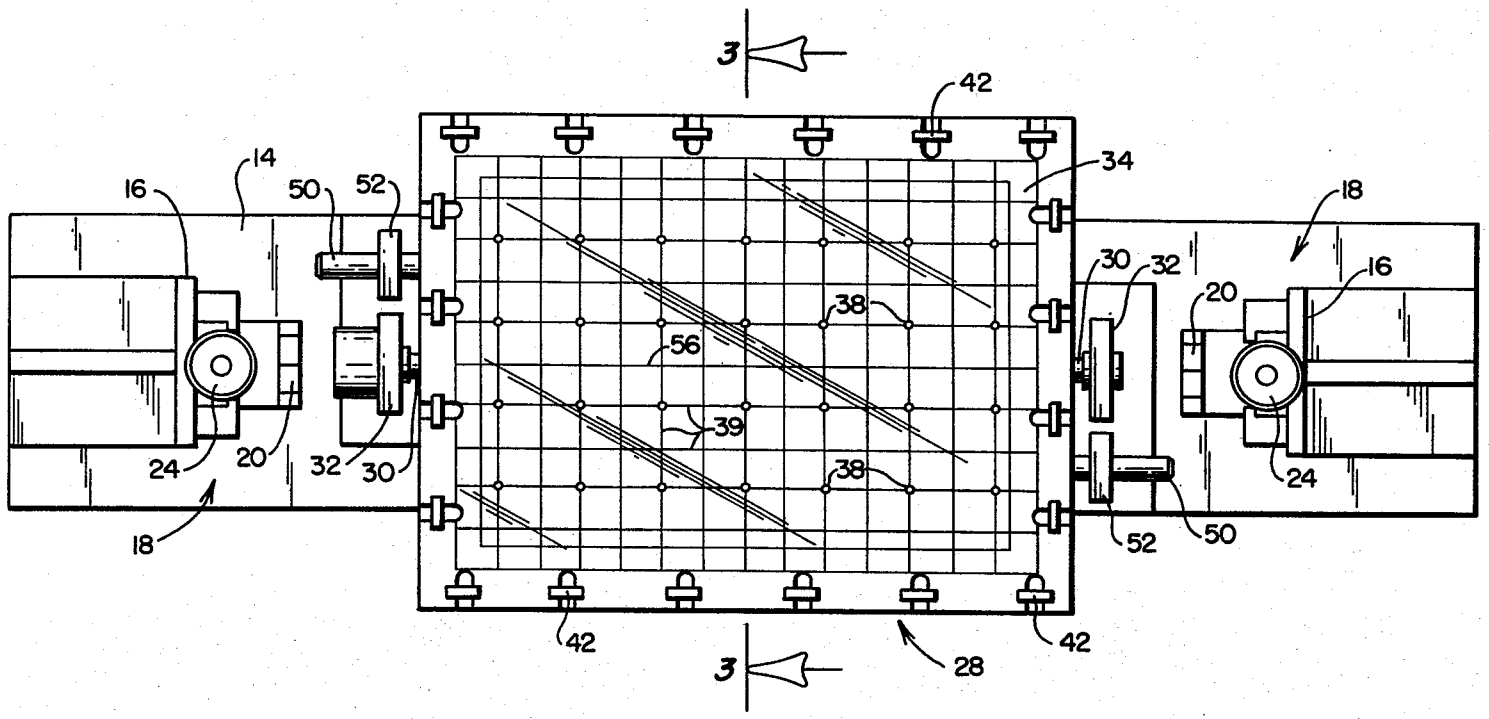
FIG. 2 is a top plan view of the apparatus of FIG. 1.

Looking to FIG. 2, indicia are shown as viewed from above the panel 28 and in one embodiment such indicia (gridwork 39 in the embodiment shown) are carried by the transparent section 34 but it will be clear that the indicia may be carried by the first transparent panel and if desired, the transparent section and the first transparent panel may be one element without departing from the concept of the invention.

A second transparent panel 40 is connected to the first transparent panel by quick-connect screw elements 42 and the transparent plastic panels 36 and 40 are held in spaced-apart position by spacer-ring 44 which defines the outer peripheral boundary of a hollow 46.

It will be observed that one or both of pins 30 include an axially extending duct 48, best seen in FIGS. 3 and 4, and duct 48 (and thereby hollow 46) is connected to a vacuum system (not shown) which, when actuated, allows a vacuum to be drawn on hollow 46, thereby holding the flexible printing plate 10 in relatively firm and stationary position of the upper surface of panel 28 even though the panel may be tilted out of horizontal position for reasons which will be explained subsequently.

In operation, a desired print plate 10 is first provided and it is disposed on the upper surface of panel 28 with the printing surface facing downward as observed in FIG. 1. After it is placed in the generally desired position, the vacuum system is actuated to hold the plate 10 generally in stationary position. It should be emphasized that the degree of vacuum drawn in the preferred embodiment is roughly twenty-five inches of mercury and in fact, the combined size of apertures 38, the leakage in the system, the size of panel 36 and the force exerted by the vacuum system itself are such that the plate 10 will remain in position on panel 28 even though the panel may be tilted 90° to a position that extends substantially vertical as opposed to horizontal as shown in FIGS. 1 and 3. However, the vacuum is not so great as to prevent the manual shifting of the plate 10 with respect to transparent section 34 without stretching or distorting the flexible, relatively elastomeric, printing plate.

After the vacuum system has been actuated, locking pins 50 will be withdrawn from the openings in vertical shafts 52 to allow the panel 28 to be pivoted about the axis of pins 30. Locking pins 50 may not be necessary but they are used in practice to prevent the inadvertent tilting of the panel 28 during the mounting process.

The plate is rotated to a position where the operator can view the orientation of the printing surface of plate 10 with respect to indicia 39 on one surface of transparent section 34. This is usually accomplished by tilting the panel 28 about 135° from its horizontal position so that the operator can see through the transparent plastic panels 36 and 40 and upon observation can move the plate 10 in accordance with the indicated desired position of the indicia on transparent section 34. As stated above, the criticality of having the printing section aligned squarely on the plate cylinder 12 is absolutely critical and this can be accomplished using the apparatus of this invention only by their proper alignment at this step of the mounting process.

Having accomplished this purpose, the panel 28 is rotated back to its horizontal position with the printing plate 10 on the upper surface of the panel 28 and with its print surface facing downward in contact with transparent section 34. A cylindrical printing cylinder is then mounted on the bracket 18 with its spindles 26 lying in the V-shaped troughs 20 thereby aligning the axes as indicated previously. When the print wheel 12 is placed in position, it will already carry the appropriate adhesive "sticky back" which will be protected by a releasable paper shield. The paper shield will be stripped from the periphery of the cylinder and using the screws 24 the cylinder 12 will be lowered into contact with the exposed surface of printing plate 10 such that line contact will be made and the print plate will be adhesively bonded to the cylinder. At this point the vacuum will be released and the free ends of the printing plate 10 will be flipped or drawn around the cylinder which is now ready to use in the printing process.

Figure 5:
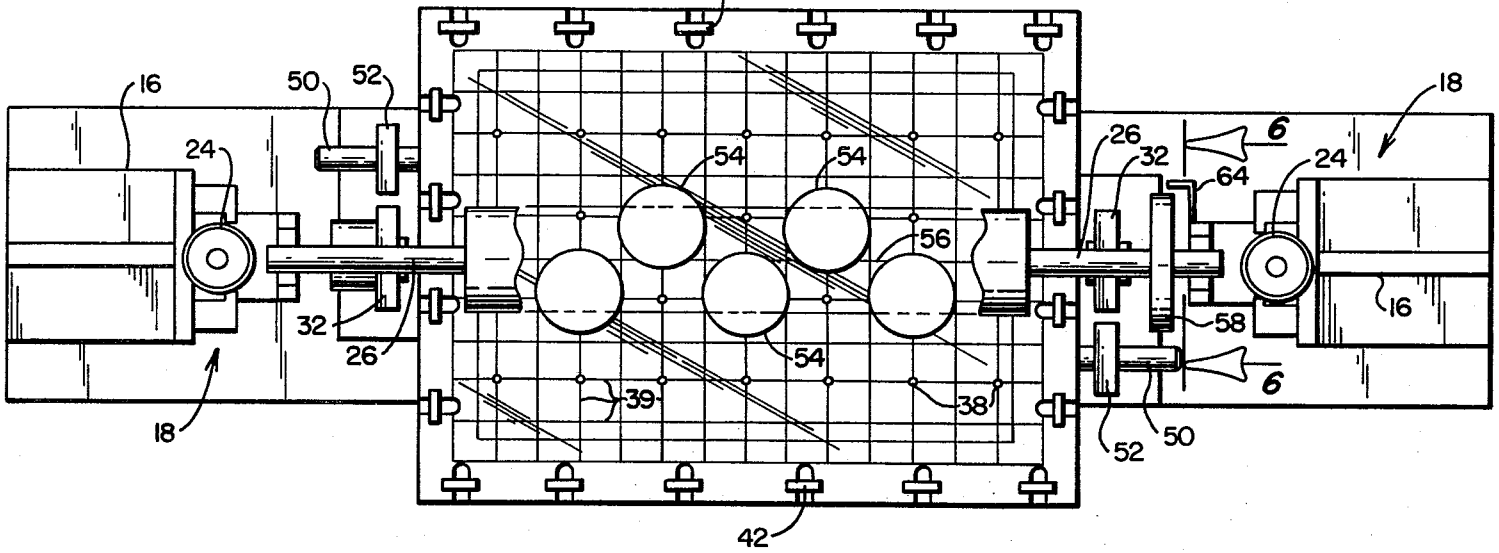
FIG. 5 is a plan view similar to FIG. 2, but showing a separate embodiment of the invention where the composite print plate of FIG. 2 comprises a plurality of discrete plates mounted individually.
Figure 6:
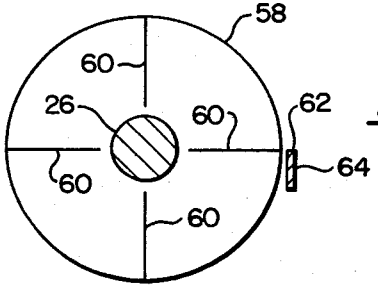
FIG. 6 is a sectional view taken along line 6—6 of FIG. 5.

Turning now to another embodiment illustrated in FIGS. 5 and 6, there will be occassions when there is no unified printing plate designed to conform to all of the printing designs desired and as a result, the "printing plate" will consist of a plurality of print elements or individual discrete printing plates 54 which will be assembled, mounted and aligned individually according to indicia on the transparent section 34 and in accordance with the obviously stated sequential steps. However, there is a characteristic which must be observed and that is that each of the discrete printing plates 54 must extend across a plane extending perpendicular to plate 28 and extending through the axis of plate cylinder 12. Otherwise, the descent of the cylinder 12 into contact with the panel 28 would not contact the individual discrete printing plates and thus there would be no bonding of plates 54 to the cylinder 12. Indeed, unless each individual plate is extending across the plane described, there will be no contact at all.

What occurs when there is no composite print plate available for mounting in one operation is a plurality of mounting operations where the cylinder is reciprocated back and forth between the plate 28, each time picking up a set of discrete printing plates. In the situation indicated the centerline 56 of panel 28 would lie in the plane discussed. Accordingly, each of the discrete printing plates 54 would extend across centerline 56. The question would be, how does one align a second set of discrete printing plates 54 with the first set picked up and bonded to the print cylinder 12? The answer is that a dividing wheel 58 is mounted on one spindle 26 and a predetermined series of dividing lines 60 are inscribed thereon. During the first sequence when the first set of discrete printing plates is picked up, one of the dividing lines 60 is aligned with a reference point 62, which in this case is the upper surface of a dividing bracket 64. Then when the second set of discrete printing plates is mounted in place, the cylinder can be rotated until the next dividing line 60 aligns with reference point 62. At this point, the cylinder is lowered into contact with the new discrete printing plates and the process continues. In FIG. 6 dividing lines 60 are illustrated as 90° apart but the angular spacing will depend upon the size of the print wheel and the size of the plates and special situations can be accommodated by a proper series of dividing lines.

In the prior art, hand-eye coordination of the operator is the most important part of the process for mounting the plate on the cylinder. In the instant invention, apparatus is provided which makes pre-alignment simple and easy; if a mistake in alignment is made due to an inadvertent muscle twitch, nothing is lost. The operator simply readjusts the plate prior to bringing the plate and cylinder together. After alignment is made by adjusting the plate according to the aligning indicia, the bringing together of the plate and cylinder is essentially a "hands-off" operation. That is, no hands touch the cylinder or the plate after the operator is satisfied that the plate is in proper position and the spindles of the cylinder are seated in the V-shaped support blocks.

Having thus described the invention in its preferred embodiment, it will be clear to those having ordinary skill in the art that modifications may be made to the apparatus and process steps to the extent that certain changes can be made without departing from the spirit of the invention. It is not intended that the words used in describing the preferred embodiments nor the drawings be limiting on the invention, rather it is intended that the invention be limited only by the scope of the appended claims.

I claim:

1. Apparatus for mounting a flexible printing plate in predetermined alignment on a print cylinder comprising, a pair of transparent plastic panels mounted in spaced apart relationship, the panels being held in spaced relationship by a spacer-ring, the spacer-ring extending in a closed loop and being sandwiched between the two panels to form a hollow between the panels, said hollow being circumscribed by the spacer-ring, an opening through one side of the spacer-ring, means for withdrawing gas from said hollow through said opening to form a vacuum within said hollow, one of said panels being porous, support means allowing rotation of said panels about an axis parallel to the axis of said print cylinder when said cylinder has been reciprocated into contact with a printing plate mounted on the porous panel, a print cylinder mounted with a particular orientation with respect to said porous panel and means for reciprocating the cylinder with respect to the panels and in a plane perpendicular to said panels, means for checking the alignment of a flexible printing plate with respect to the particular alignment of the print cylinder at a time when said printing plate is held stationary on said porous panel by a vacuum drawn in the hollow.

2. The apparatus of claim 1 including indicia associated with the porous panel for assisting in said alignment.

3. The apparatus of claim 2 wherein the degree of porosity of the porous panel, the leakage in the vacuum system and the size of the porous panel combined with the power of the vacuum system are such that the printing plate may be manually moved with respect to the porous panel while the vacuum is at its maximum during the alignment process and at the same time the magnitude of the vacuum is such that the printing plate will be held stationary against the force of gravity.

4. The apparatus of claim 2 wherein the plate comprises a plurality of discrete printing surfaces which are aligned individually on the porous panel according to said indicia, a disc mounted on a spindle extending from one end of said printing cylinder, means associated with said disc for allowing the operator of the apparatus to determine and adjust the degree of rotation of the cylinder during successive reciprocations of the cylinder into contact with said discrete printing surfaces and away from the porous panel.

5. The apparatus of claim 1 wherein the panels are supported by means for allowing their rotation about an axis parallel to the axis of said print cylinder when said cylinder has been reciprocated into contact with a printing plate mounted on the porous panel.

6. The apparatus of claim 5 wherein the degree of porosity of the porous panel, the leakage in the vacuum system and the size of the porous panel combined with the power of the vacuum system are such that the printing plate may be manually moved with respect to the porous panel while the vacuum is at its maximum during the alignment process and at the same time the magnitude of the vacuum is such that the printing plate will be held stationary against the force of gravity.

7. The apparatus of claim 1 wherein the degree of porosity of the porous panel, the leakage in the vacuum system and the size of the porous panel combined with the power of the vacuum system are such that the printing plate may be manually moved with respect to the porous panel while the vacuum is at its maximum during the alignment process and at the same time the magnitude of the vacuum is such that the printing plate will be held stationary against the force of gravity.

8. A process for mounting a flexible printing plate on a print cylinder comprising, providing a porous transparent panel having aligning indicia thereon, supporting the panel on a pair of coaxially aligned pins, and with the axis being substantially horizontal, pivoting the panel on the pins to a substantially horizontal position, placing a flexible printing plate face down on the upper side of the panel, drawing a vacuum on the under side of the panel to thereby hold the plate in place on the panel, pivoting the panel about said axis to an orientation such that the operator may view the indicia and the printing surface of the plate through the transparent panel, adjusting the plate as necessary to align the same according to said indicia, pivoting the panel to horizontal position with the printing side of the plate facing downward, applying an adhesive to a print cylinder, mounting the cylinder with its axis parallel with the upper surface of the porous panel and such that it is aligned with the plate, said cylinder axis lying in a plane perpendicular to said porous panel, moving the cylinder and panel toward each other with the cylinder axis remaining in the plane and while maintaining the parallel relationship until the cylinder contacts and adheres to said plate, releasing the vacuum, drawing the free portion of the flexible plate around the cylinder.

9. The process of claim 8 wherein the step of placing of said plate on the panel includes placing a plurality of printing plates on said panel with each said plate including a portion extending across a plane perpendicular to said panel and passing through the axis of said cylinder.

10. The process of claim 9 followed by retracting the cylinder from the panel with the plates adhered thereto, rotating the cylinder about its axis for a predetermined angle, placing additional plates on the panel with each extending across said plane, moving the panel and cylinder toward each other a second time and in the same manner as claim 9.

11. The process of claim 8 followed by retracting the cylinder from the panel with the plate adhered thereto, rotating the cylinder about its axis for a predetermined angle, placing an additional plate on the panel, aligning it in the same steps as the first plate and moving the panel and cylinder toward each other a second time and in the same manner as claim 9.

* * * * *